US009243596B2

(12) United States Patent
Hornby et al.

(10) Patent No.: US 9,243,596 B2
(45) Date of Patent: Jan. 26, 2016

(54) PRESSURE OPERATED MECHANICAL FLOW CONTROL VALVE FOR GASOLINE DIRECT INJECTION PUMP

(75) Inventors: Michael Hornby, Williamsburg, VA (US); David Humblot, Newport News, VA (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 1170 days.

(21) Appl. No.: 13/231,200

(22) Filed: Sep. 13, 2011

(65) Prior Publication Data

US 2013/0061830 A1 Mar. 14, 2013

(51) Int. Cl.

| | |
|---|---|
| ***F02M 59/46*** | (2006.01) |
| ***F04B 19/00*** | (2006.01) |
| ***F02M 63/00*** | (2006.01) |
| ***F02M 63/02*** | (2006.01) |
| ***F02M 59/36*** | (2006.01) |

(52) U.S. Cl.

CPC ..... *F02M 59/464* (2013.01); *F02M 59/36* (2013.01); *F02M 63/0028* (2013.01); *F02M 63/0265* (2013.01)

(58) Field of Classification Search

CPC . F02M 63/0028; F02M 59/464; F02M 59/36; F02M 63/0265

USPC ..... 123/446, 495, 496; 417/470

See application file for complete search history.

(56) References Cited

U.S. PATENT DOCUMENTS

| | | | | |
|---|---|---|---|---|
| 4,618,189 | A * | 10/1986 | Nakanishi | B60T 8/4291 303/115.4 |
| 5,378,055 | A * | 1/1995 | Maas | B60T 8/4291 303/113.1 |
| 6,135,090 | A * | 10/2000 | Kawachi | F02D 41/3809 123/446 |
| 6,209,527 | B1 * | 4/2001 | Bueser | F16K 17/06 123/506 |
| 7,513,240 | B2 * | 4/2009 | Usui | F02M 55/04 123/446 |
| 2003/0059322 | A1 * | 3/2003 | Hiraku | F02M 59/368 417/505 |
| 2008/0056914 | A1 * | 3/2008 | Usui | F02M 55/04 417/307 |
| 2010/0242922 | A1 * | 9/2010 | Mancini | F02M 59/462 123/506 |

FOREIGN PATENT DOCUMENTS

| | | | |
|---|---|---|---|
| DE | 19527402 | A1 | 1/1997 |
| DE | 19834120 | A1 | 2/2000 |
| DE | 10229395 | A1 | 1/2004 |
| DE | 102006013703 | A1 | 9/2007 |
| EP | 2434137 | A1 | 3/2012 |
| WO | 2011048456 | A1 | 4/2011 |

OTHER PUBLICATIONS

Search Report and the Written Opinion of the International Searching Authority PCT/US2012/054584.

* cited by examiner

*Primary Examiner* — Mahmoud Gimie
*Assistant Examiner* — David Hamaoui

(57) ABSTRACT

A flow control valve (15) for a direct injection pump (10) has an inlet end (12), an inlet valve (26), a compression chamber (48), a pump piston (14), and an outlet (13). The valve (15) has a housing (16) and a non-electrically operated control plunger (22) movable within the housing. The control plunger engages with and disengages from the inlet valve to control opening and closing of the inlet valve. A spring (28) biases the control plunger away from the inlet valve. The pump and housing define port structure (38, 44) fluidly connecting the outlet with a volume (42) that communicates with the control plunger such that when fluid pressure at the outlet is greater than a certain value, the fluid pressure in the volume alone causes the control plunger to move against the spring and engage the inlet valve to hold the inlet valve in an open position.

11 Claims, 1 Drawing Sheet

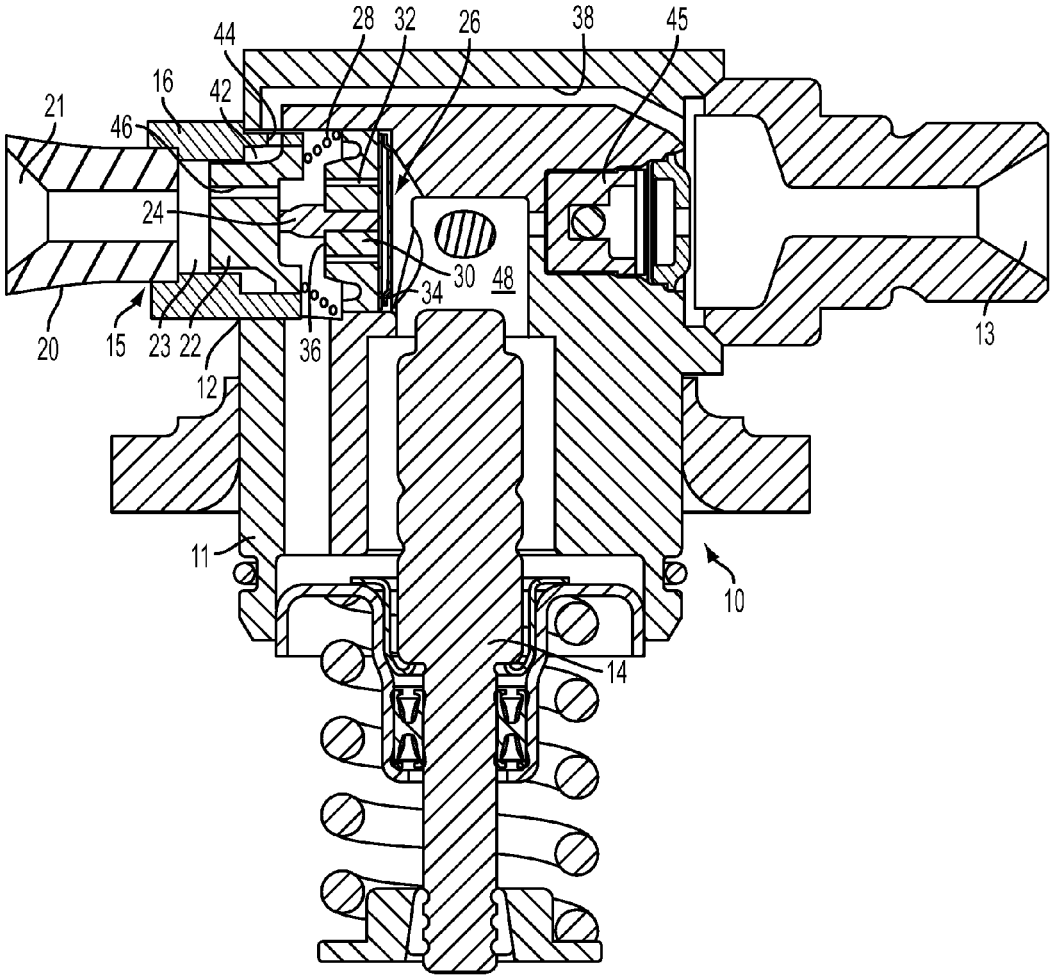
44
28
32
26
38
45
16
42
21
46
24
30
48
34
20
15
23
22
36
12
13
11
10
14

PRESSURE OPERATED MECHANICAL FLOW CONTROL VALVE FOR GASOLINE DIRECT INJECTION PUMP

TECHNICAL FIELD

The present disclosure relates to a direct injection high pressure pumps for automobiles and, more particularly, to a pressure operated, mechanical flow control valve for the pump inlet.

BACKGROUND

In today's automotive engine systems, there is an increased demand for low cost, direct injection. In common rail injection systems, the fuel is delivered by means of a high pressure pump located in an engine compartment to a fuel rail which serves as a pressurized storage reservoir for the fuel. The fuel is under high pressure in the fuel rail and can be injected directly into the cylinders via injectors connected to the rail.

Typical direct injection, high pressure pumps of the type disclosed in U.S. Patent Application Publication No. 20100242922 A1 have a solenoid valve at the inlet as a flow control valve to control flow rate through the pump. The solenoid valve is complicated, requires an electrical connection to a power source, as well as a complex control system, and adds cost to the high pressure pump.

There is a need for a pressure operated, mechanical flow control valve that is simple in construction, eliminates electronic control and delivers fuel under a single pressure to a fuel rail.

SUMMARY

An object of the invention is to fulfill the need referred to above. In accordance with the principles of the present invention, this objective is achieved by providing a flow control valve for a high pressure, direct injection pump. The pump has an inlet end, an inlet valve at the inlet end, a compression chamber, a pump piston for increasing pressure of fuel, and an outlet. The flow control valve includes a housing constructed and arranged to be coupled to the inlet end of the pump. The housing defines an inlet in communication with the inlet valve when the housing is coupled to the pump. The housing also includes an interior portion. A non-electrically operated control plunger is movable within the interior portion. The control plunger is constructed and arranged, when the housing is coupled to the pump, to engage with and disengage from a portion of the inlet valve to control opening and closing of the inlet valve. A spring biases the control plunger away from the inlet valve. The pump and housing define port structure fluidly connecting the outlet with a volume that communicates with the control plunger such that when fluid pressure at the outlet is greater than a certain value, the fluid pressure in the volume alone causes the control plunger to move against the bias of the spring and engage the portion of the inlet valve to hold the inlet valve in an open position, causing fuel to be pushed back towards the inlet of the housing, with no flow fuel flowing from the outlet. When the fuel pressure returns to the certain value, the control plunger is biased by the spring to disengage the portion of the inlet valve, causing the inlet valve to operate as a pressure operated check valve, with only fuel at the certain value being delivered through the outlet.

In accordance with another aspect of an embodiment, a high pressure, direct injection pump supplies fuel to a fuel rail. The pump includes a body having an inlet end, an outlet, and a pump piston between the inlet end and the outlet to increase pressure of fuel. An inlet valve is provided at the inlet end. The pump includes a flow control valve having a housing coupled to the inlet end of the body with the housing defining an inlet in communication with the inlet valve. A non-electrically operated control plunger is movable within an interior portion of the housing. The control plunger is constructed and arranged to engage with and disengage from a portion of the inlet valve to control opening and closing of the inlet valve. A spring biases the control plunger away from the inlet valve. The body of the pump and the housing defines port structure fluidly connecting the outlet with a volume that communicates with the control plunger such that when fluid pressure at the outlet is greater than a certain value, the fluid pressure in the volume alone causes the control plunger to move against the bias of the spring and engage the portion of the inlet valve to hold the inlet valve in an open position, causing fuel to be pushed back towards the inlet of the housing, with no flow fuel flowing from the outlet. When the fuel pressure returns to the certain value, the control plunger is biased by the spring to disengage from the portion of the inlet valve, causing the inlet valve to operate as a pressure operated check valve, with only fuel at the certain value being delivered from the outlet.

In accordance with yet another aspect of an embodiment, a method of delivering fuel at a certain pressure from a high pressure direct injection pump provides a direct injection pump having an inlet, an outlet, a pump piston between the inlet and the outlet to increase pressure of fuel, and an inlet valve associated with the inlet. A non-electrically operated flow control valve is provided upstream of the inlet valve. The flow control valve has a movable portion. Fuel pressure at the outlet is permitted to communicate with the flow control valve so that when fluid pressure at the outlet is greater than a certain value, the fluid pressure alone causes the movable portion of the flow control valve engage a portion of the inlet valve to hold the inlet valve in an open position, causing fuel to be pushed back towards the inlet, with no flow fuel flowing from the outlet. When the fuel pressure returns to the certain value, the movable portion of the flow control valve disengages from the portion of the inlet valve, causing the inlet valve to operate as a pressure operated check valve, with only fuel at the certain value being delivered from the outlet.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which:

FIG. 1 is sectional view of a direct injection, high pressure fuel pump having a pressure operated, mechanical flow control valve provided in accordance with an example embodiment of the present invention.

DETAILED DESCRIPTION OF EXAMPLE EMBODIMENTS

Referring to FIG. 1, a direct injection, high pressure pump is shown, generally indicated at 10, in accordance with an example embodiment of the present invention. The pump 10 is preferably of the conventional single-piston type having a body 11 with an inlet end 12 and an outlet 13. A piston 14 is provided between the inlet end 12 and the outlet 13. The piston 14 is associated with a camshaft to bring fuel to the required high pressure levels.

The pump 10 includes a pressure operated, mechanical flow control valve, generally indicated at 15. The valve 15 includes a housing 16 coupled to the body 11 of the pump 10 at an inlet end 12 thereof. An inlet fitting 20 is coupled to the housing 16 and defines an inlet 21 of the pump 10. The inlet fitting 20 can be considered to be part of the housing 16 and is constructed and arranged to be connected to communicate with an outlet of a low pressure fuel pump. A control plunger 22 is movable within an interior portion 23 of the housing 16. A pin 24 is coupled to and extends from the control plunger 22. The pin 24 is associated with an inlet valve, generally indicated at 26. The pin 24 can be considered to be part of the control plunger 22. A compression spring 28 biases the control plunger 22 towards the inlet 21 and away from the inlet valve 26, which is in communication with the inlet 21. Thus, the flow control valve 10 is disposed upstream of the inlet valve 26. The inlet valve 26 is conventional and can be of the type disclosed in U.S. Patent Publication No. 20100242922 A1, the contents of which is hereby incorporated into this specification by reference. Thus, in the embodiment, the inlet valve 26 includes a valve disk 30 having a plurality of openings 32 there-through and a circular, deformable valve plate or blade 34 having a surface constructed and arranged engage the valve disc 30, cover and thus close the openings 32. Thus, when the pin 24 is not engaged with the valve blade 34, the openings 32 are covered by the valve blade 34, defining a closed position of the inlet valve 26. When the pin 24 engages the valve blade 34, the valve blade 34 is moved axially and held by the pin 26 so as not to cover the openings 32, defining a held-open position of the inlet valve 26. Other types of inlet valves 26 (e.g., flat, ball, poppet, etc.) can be used that can be controlled by movement of the control plunger 22.

The pump 10 includes a port 38 fluidly communicating the high pressure side outlet 13 to a low pressure side volume 42 associated with the inlet 21. A port 44 through the housing 16 communicates the port 38 with the volume 42. Ports 38 and 44 define port structure of the pump 10. A check valve 45 is provided at the outlet 13. The outlet 13 is constructed and arranged to be connected to a direct injection fuel rail (not shown) of a vehicle.

Low pressure fuel, e.g., at 5 bar, sent from a low pressure fuel pump (not shown) is received at the inlet fitting 20. The fuel moves the control plunger 22 to the right in FIG. 1 causing the pin 26 to push the valve blade 34 away from the valve disk 30, thereby permitting fuel to flow through the openings 32 into a pump compression volume 48 during a filling phase. During a compression phase, the pump 10 compresses the fuel in the volume 48 to increase the pressure thereof. Volume 48 communicates with an outlet check valve 45 and thus the outlet 13.

When the fuel pressure at the pump outlet 13 is greater than a certain value, e.g., 70 bar, the fuel under pressure that is sent through ports 38, 44 to volume 42 is exerted on the control plunger 22. Since the fuel pressure on the plunger 22 is greater than the load of the spring 28, the plunger 22 moves the pin 26 into engagement with a stop surface 36 of the valve disk 30, holding the inlet valve 26 open by pushing the valve blade 34 away from the valve disk 30, permitting fuel to flow through the openings 32. Since the inlet valve 26 is held open, there is no flow out of the outlet 13 of the pump 10 since fuel flow is pushed back to the low pressure inlet side of the pump 10, through openings 32 in the valve disk and the passage 46 in the plunger 22. The rate of the spring 28 controls the certain pressure value of the fuel to be delivered to the fuel rail. When outlet fuel pressure comes back to certain pressure value, the plunger 22 moves via the force of the spring 28 towards the inlet 21, together with the pin 26, to disengage from the valve blade 34, with the inlet valve 26 opening and closing as a conventional pressure operated check valve. In other words, without any external action from the pin 26, the inlet valve 26 is closed when the fuel pressure in the compression chamber 48 is higher than the fuel pressure in the inlet 21 and is open when the fuel pressure in the compression chamber 48 is lower than the fuel pressure in the inlet 21. Thus, due to the pressure-operated plunger 22 and calibrated spring 28, only a single pressure of fuel (e.g., 70 bar) is delivered by the pump 10 to the fuel rail.

Thus, the mechanical flow control valve 15, operating solely on pressure differences between the outlet 13 and the inlet 21 is less costly than conventional solenoid flow control valves and can provide a fuel at only one pressure to the fuel rail.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A flow control valve for a high pressure, direct injection pump, the pump having an inlet end, an inlet valve at the inlet end, a compression chamber, a pump piston for increasing pressure of fuel, and an outlet, the flow control valve comprising:

a housing constructed and arranged to be coupled to the inlet end of the pump, the housing defining an inlet in communication with the inlet valve when the housing is coupled to the pump, the housing including an interior portion, a non-electrically operated control plunger, movable within the interior portion, the control plunger being constructed and arranged, when the housing is coupled to the pump, to engage with and disengage from a portion of the inlet valve to control opening and closing of the inlet valve, wherein the control plunger has a passage there-through, and a spring biasing the control plunger away from the inlet valve, wherein the pump and housing define port structure fluidly connecting the outlet with a volume that communicates with the control plunger such that when fluid pressure at the outlet is greater than a certain value, the fluid pressure in the volume alone causes the control plunger to move against the bias of the spring and engage the portion of the inlet valve to hold the inlet valve in an open position, causing fuel to be pushed back towards the inlet of the housing, with no flow fuel flowing from the outlet, and when the fuel pressure returns to the certain value, the control plunger is biased by the spring to disengage the portion of the inlet valve, causing the inlet valve to operate as a pressure operated check valve, with only fuel at the certain value being delivered through the outlet.

2. The valve of claim 1, wherein the control plunger includes a pin extending there-form, the pin being constructed and arranged to engage with and disengage from the portion of the inlet valve.

3. The valve of claim 1, wherein the spring is a coil compression spring.

4. The valve of claim 1, wherein the housing includes an inlet fitting constructed and arranged to be connected to an outlet of a low pressure fuel pump.

5. A high pressure, direct injection pump for supplying fuel to a fuel rail, the pump comprising:

a body having an inlet end, an outlet, and a pump piston between the inlet end and the outlet to increase pressure of fuel, an inlet valve at the inlet end, and a flow control valve comprising:

a housing coupled to the inlet end of the body, the housing defining an inlet in communication with the inlet valve, the housing including an interior portion, a non-electrically operated control plunger, movable within the interior portion, the control plunger being constructed and arranged to engage with and disengage from a portion of the inlet valve to control opening and closing of the inlet valve, wherein the control plunger has a passage there-through, and a spring biasing the control plunger away from the inlet valve, the body of the pump and the housing defining port structure fluidly connecting the outlet with a volume that communicates with the control plunger such that when fluid pressure at the outlet is greater than a certain value, the fluid pressure in the volume alone causes the control plunger to move against the bias of the spring and engage the portion of the inlet valve to hold the inlet valve in an open position, causing fuel to be pushed back towards the inlet of the housing, with no flow fuel flowing from the outlet, and when the fuel pressure returns to the certain value, the control plunger is biased by the spring to disengage from the portion of the inlet valve, causing the inlet valve to operate as a pressure operated check valve, with only fuel at the certain value being delivered from the outlet.

6. The pump of claim 5, wherein the control plunger includes a pin extending there-form, the pin being constructed and arranged to engage with and disengage from the portion of the inlet valve.

7. The pump of claim 6, wherein the inlet valve includes valve disk having openings there-through, and a deformable valve blade covering the openings in a closed position of the inlet valve, the valve blade defining the portion of the inlet valve that is engaged and disengaged, such that when the valve blade is engaged by the pin, the valve blade is moved to a position so as not to cover the openings, thereby defining a held open position of the inlet valve.

8. The pump of claim 5, wherein the spring is a coil compression spring.

9. The pump of claim 5, wherein the housing includes an inlet fitting constructed and arranged to be connected to an outlet of a low pressure fuel pump.

10. The pump of claim 5, further comprising an outlet check valve associated with the outlet.

11. The pump of claim 5, wherein the inlet valve defines a stop surface that is engaged by the pin in the open position of the inlet valve.

* * * * *